US007917975B2

(12) United States Patent
Bartelsmeyer et al.

(10) Patent No.: US 7,917,975 B2
(45) Date of Patent: Apr. 5, 2011

(54) CONTROLLED MOTION BED-FRAME POSITIONING ASSEMBLY

(75) Inventors: Robert A. Bartelsmeyer, High Point, NC (US); David W. Stroud, Lexington, NC (US)

(73) Assignee: L & P Property Management Company, South Gate, CA (US)

( * ) Notice: Subject to any disclaimer, the term of this patent is extended or adjusted under 35 U.S.C. 154(b) by 29 days.

(21) Appl. No.: 12/358,438

(22) Filed: Jan. 23, 2009

(65) Prior Publication Data

US 2009/0188036 A1 Jul. 30, 2009

Related U.S. Application Data

(60) Provisional application No. 61/023,471, filed on Jan. 25, 2008.

(51) Int. Cl.
*A47C 31/00* (2006.01)

(52) U.S. Cl. ..... 5/11; 5/111; 5/21

(58) Field of Classification Search ..... 5/11, 111, 5/21

See application file for complete search history.

(56) References Cited

U.S. PATENT DOCUMENTS

| | | | | | |
|---|---|---|---|---|---|
| 2,150,879 | A | * | 3/1939 | Fox | 5/21 |
| 2,167,175 | A | * | 7/1939 | Fox | 5/21 |
| 2,291,392 | A | * | 7/1942 | Krakauer | 5/21 |
| 2,328,411 | A | * | 8/1943 | Bergstrom | 5/21 |
| 2,652,573 | A | * | 9/1953 | Clerc | 5/21 |
| 3,855,650 | A | * | 12/1974 | Neunherz et al. | 5/21 |
| 4,196,483 | A | * | 4/1980 | Lefler et al. | 5/11 |
| 4,449,262 | A | * | 5/1984 | Jahsman et al. | 5/11 |
| 4,768,242 | A | * | 9/1988 | LoTurco | 5/11 |
| 5,594,961 | A | * | 1/1997 | Yokoi et al. | 5/11 |

* cited by examiner

*Primary Examiner* — Robert G Santos
*Assistant Examiner* — Brittany M Wilson
(74) *Attorney, Agent, or Firm* — Shook Hardy & Bacon LLP

(57) ABSTRACT

Our invention is related to a pop-up bed frame. Aspects of our invention include a bed-frame positioning assembly for raising and lowering an upper frame in a controlled manner. A bed-frame positioning assembly generally includes a set of scissor arms that is operatively coupled to a biasing member. Force exerted on the set of scissor arms by the biasing member either opens or closes the set of scissor arms, thereby either raising or lowering an upper frame coupled thereto.

20 Claims, 3 Drawing Sheets

CONTROLLED MOTION BED-FRAME POSITIONING ASSEMBLY

CROSS-REFERENCE TO RELATED APPLICATIONS

This is a nonprovisional patent application related to U.S. Patent Application No. 61/023,471, which is a provisional patent application filed on Jan. 25, 2008. Accordingly, this application claims the benefit of, and incorporates herein by reference, U.S. Patent Application No. 61/023,471.

BACKGROUND

Trundle beds are used by many people today as a way to provide additional bedding while conserving space within a room. A trundle bed is basically a low bed on casters that can be rolled or moved under another bed. This hides the trundle bed while it is not in use. To use the trundle bed, the user pulls the trundle bed from under the other bed.

While trundle beds offer space saving advantages, they do not offer the same sleep experience as a regular bed, in that they are very low to the ground (because they have to slide under the other bed). To provide a sleep experience on a trundle bed more like a traditional bed, trundle beds are known to have frames that lift up the mattress after it is removed from under the other bed. This raises the mattress away from the floor. These types of trundle beds are sometimes called "pop-up" beds. These beds have an upper frame that is spring-loaded when in the stored condition. Once removed from under the other bed, the trundle-bed frame is unlocked to release the springs, and the frame raises the mattress. The use of springs produces a sudden and rapid rise of the mattress, which is less than desirable. These pop-up beds also have a locking link that operates to lock the mattress in the raised position. While this link might lock the mattress in the raised condition, it is possible to unlock the frame inadvertently. A more positive locking mechanism would be desirable.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Aspects of our technology relate to a bed-frame positioning assembly for raising and lowering an upper frame in a controlled manner. Exemplary embodiments include a pair of scissor arms, each having a first arm that is pivotally connected to a second arm. Each arm includes a lower end for stabilization and an upper end for communication with the upper frame, which is for supporting a mattress. In further embodiments, each first arm is both pivotably and slidably connectable to the upper frame and each second arm is slidably connectable to the upper frame. In other aspects the apparatus includes a gas cylinder or other biasing member having one end attachable to the upper frame and an opposing end coupled to one of the first arms. Accordingly, when the biasing member exerts force, e.g., pushing or pulling, on the first arm, the respective scissor arms either open or collapse, thereby either raising or lowering an upper frame coupled thereto.

In another aspect a locking plate functions to slidably and pivotably connect the upper frame, biasing member, and first arm. The locking plate has an elongated slot that guides the sliding motion of the first arm with respect to the upper frame. The locking plate is also equipped with a releasable fastener, such as a spring-loaded locking pin. The locking pin engages one of multiple holes in the first arm. When engaged in one locking hole, the upper frame is locked in the raised position. When engaged in the other locking hole, the upper frame is locked in the lowered, storage position. The upper frame has a release mechanism coupled to it that operates to release the locking pin from these two positions, when desired.

In a further aspect, the technology relates to a bed frame including an upper frame in combination with a bed-frame positioning assembly for raising and lowering the upper frame.

These and other aspects of the invention will become apparent to one of ordinary skill in the art upon a reading of the following description and drawings.

BRIEF DESCRIPTION OF THE DRAWINGS

Embodiments of the present invention are described in detail below with reference to the attached drawing figures, wherein.

DETAILED DESCRIPTION

Figure 1:
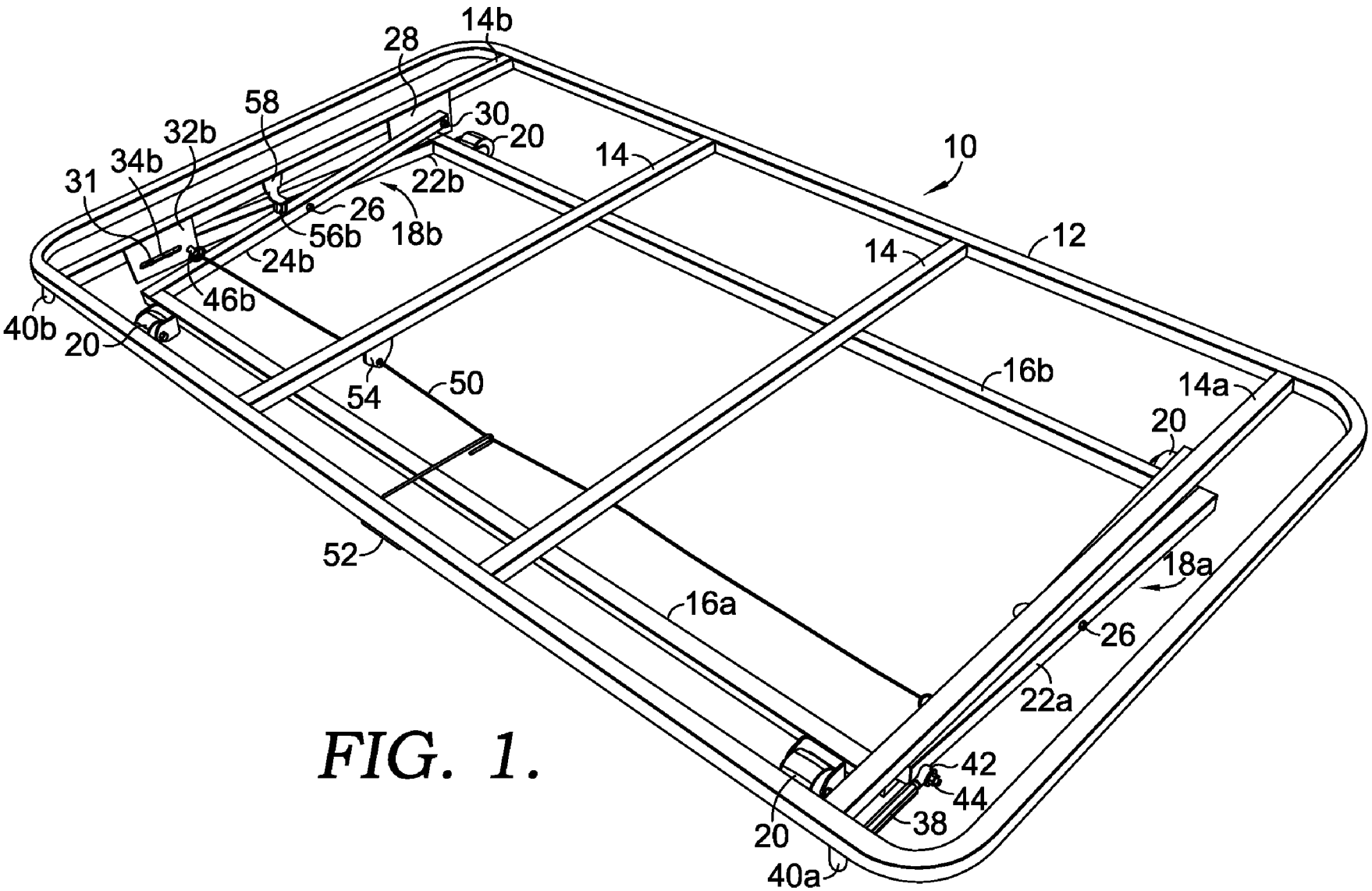
FIG. 1 is a perspective view of the bed frame in the lowered, storage position.

Referring to the drawings, and particularly to FIG. 1, there is illustrated a pop-up bed frame 10. Frame 10 is designed to support a mattress and is movable from a lowered position, shown in FIG. 1, to a raised position, shown in FIG. 2. In the lowered position, the entire unit is storable, such as beneath another bed. When the unit is moved from under the bed, the frame is movable to the raised position of FIG. 2, thereby allowing a supported mattress to raise to a height more like that of traditional beds. As discussed below, components of frame 10 enable the supported mattress to raise and lower in a slow, controlled fashion, and enable frame 10 to be positively locked in place in either the raised or lowered position.

Figure 2:
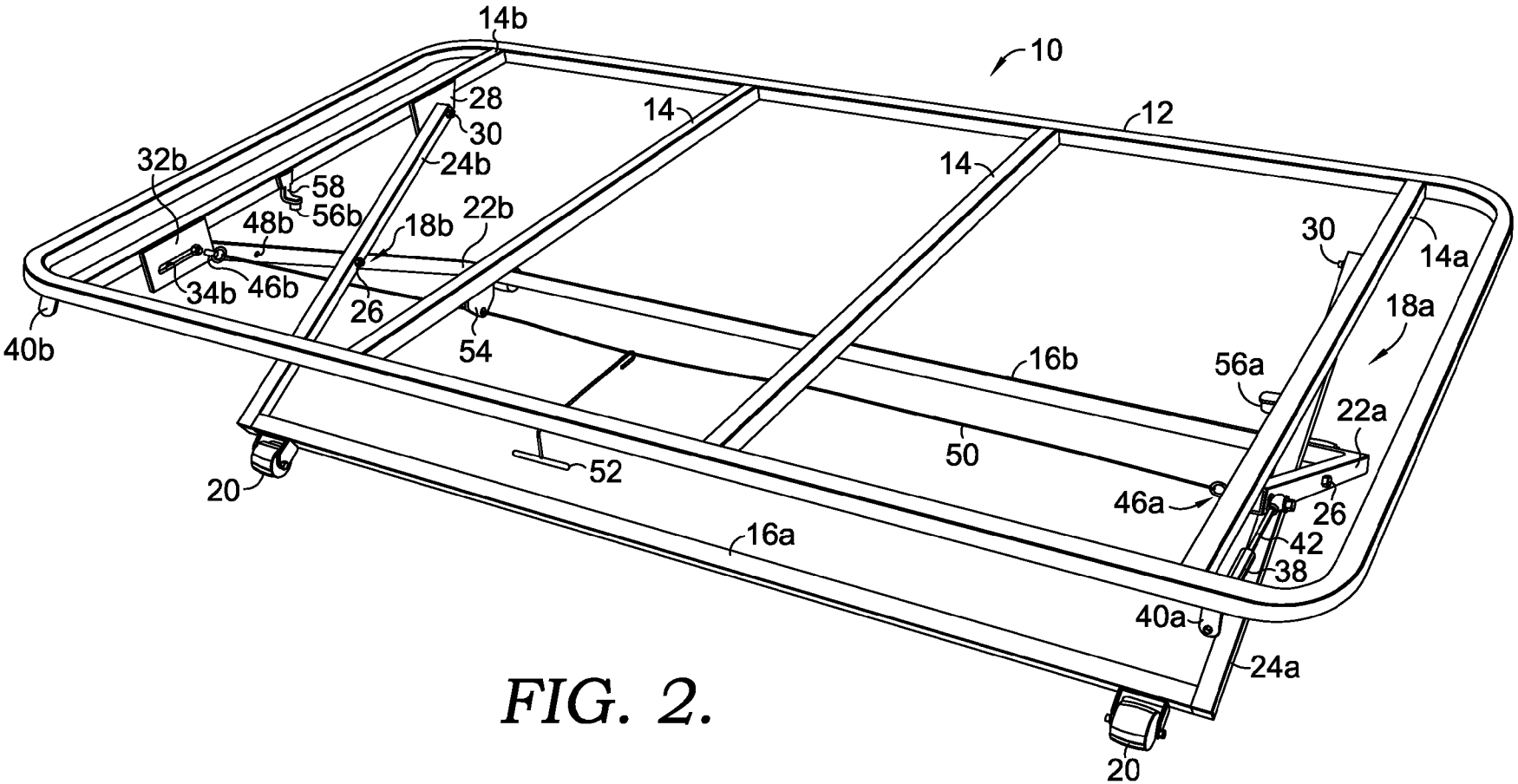
FIG. 2 is a perspective view of the bed frame in the raised position.

In an exemplary embodiment, our technology includes a positioning assembly for raising and lowering an upper frame 12, which functions to support a mattress. Upper frame 12 may be used interchangeably herein with the term mattress-supporting frame. FIGS. 1 and 2 depict a bed-frame positioning assembly in combination with an upper frame 12. While aspects of our technology do include a positioning assembly in combination with an upper frame, we have also contemplated a positioning assembly kit, which might be practiced separate from an upper frame. Accordingly, even though for illustrative purposes the figures herein depict a combination, embodiments of our invention do not require a combination.

As depicted in FIGS. 1 and 2, the positioning assembly includes two sets of scissor arms 18*a* and 18*b*, each set of scissor arms 18*a* and 18*b* having a respective first arm 22*a* and 22*b* and a respective second arm 24*a* and 24*b*. For each set of scissor arms 18*a* and 18*b*, a respective first arm 22*a* and 22*b* is pivotably coupled to a respective second arm 24*a* and 24*b*. For example, pivotable coupling of first arm 22*a* to second arm 24*a* (and 22*b* to 24*b*) might be achieved using a respective shoulder bolt 26 extending through corresponding holes in each of arms 22*a* and 24*a* (with a corresponding nut on the opposite side). To facilitate smooth operation of the scissor-arm linkage, a washer is preferably placed between the arms 22*a* and 24*a* (and 22*b* and 24*b*) at the pivot location.

In a further aspect, each first arm 22*a* and 22*b* and each second arm 24*a* and 24*b* has a lower end and an upper end. The lower end of each arm 22*a*, 22*b*, 24*a*, and 24*b* functions as a stabilizer, such as by communicating with a ground surface or by communicating with lower frame members 16*a* and 16*b*. Although not shown, in one embodiment the lower end of each arm 22*a*, 22*b*, 24*a*, and 24*b* has a caster coupled directly thereto for communicating with a ground surface. An alternative embodiment is shown in FIGS. 1 and 2, in which the lower end of each arm 22*a*, 22*b*, 24*a*, and 24*b* is rigidly coupled, preferably by welding, to either bottom frame 16*a* or 16*b*. Bottom frame 16*a* rigidly couples the lowers ends of second arms 24*a* and 24*b*, and bottom frame 16*b* rigidly couples the lower ends of first arms 22*a* and 22*b*. Moreover, coupled to each bottom frame 16*a* and 16*b* are casters 20, such that operation of the scissor-arm linkages at the pivot locations causes bottom frames 16*a* and 16*b* to be moved either closer together or farther apart. Although welding is identified as one method of coupling the lower ends of arms 22*a*, 22*b*, 24*a*, and 24*b* to bottom frame members, it should be understood that alternative components might also be acceptable. For example, to facilitate breakdown of the frame, lower ends might be coupled to bottom frame members using releasable fasteners.

The upper end of each arm 22*a*, 22*b*, 24*a*, and 24*b* functions to support upper frame 12. For example, the upper end of each second arm 24*a* and 24*b* is pivotably connectable to upper frame 12. Each second arm 24*a* and 24*b* might be connected to upper frame 12 using various components, and in a preferred embodiment, upper frame 12 includes cross members 14*a* and 14*b*. Each second arm 24*a* and 24*b* might be coupled directly to a respective cross member, such as with a fastener. In an alternative embodiment, each cross member 14*a* and 14*b* includes a respective pivot plate 28. For illustrative purposes, only pivot plate 28 for connection of cross member 14*b* to second arm 24*b* is depicted in the figures; however, it should be understood that another pivot plate is coupled to cross member 14*a* for coupling second arm 24*a*, the other pivot plate having similar respective components and configurations as pivot plate 28. Pivot plate 28 might be coupled to cross member 14*b* in various ways. In one embodiment, pivot plate 28 is coupled to cross member 14*b* using fasters, such as bolts. In other configurations pivot plate 28 is shaped to clamp around, or otherwise fit securely around, cross member 14*b*. Alternatively, pivot plate 28 is welded to cross member 14*b*. Pivot plate 28 extends below the plane of frame 12 and has a hole drilled therein. The hole is used to pivotably attach the upper end of arm 24*b* to plate 28, and thus the frame 12. This pivotable coupling might be achieved with a shoulder bolt 30 (and corresponding nut), although other pivotable attachment methods could certainly be used.

Figure 3:
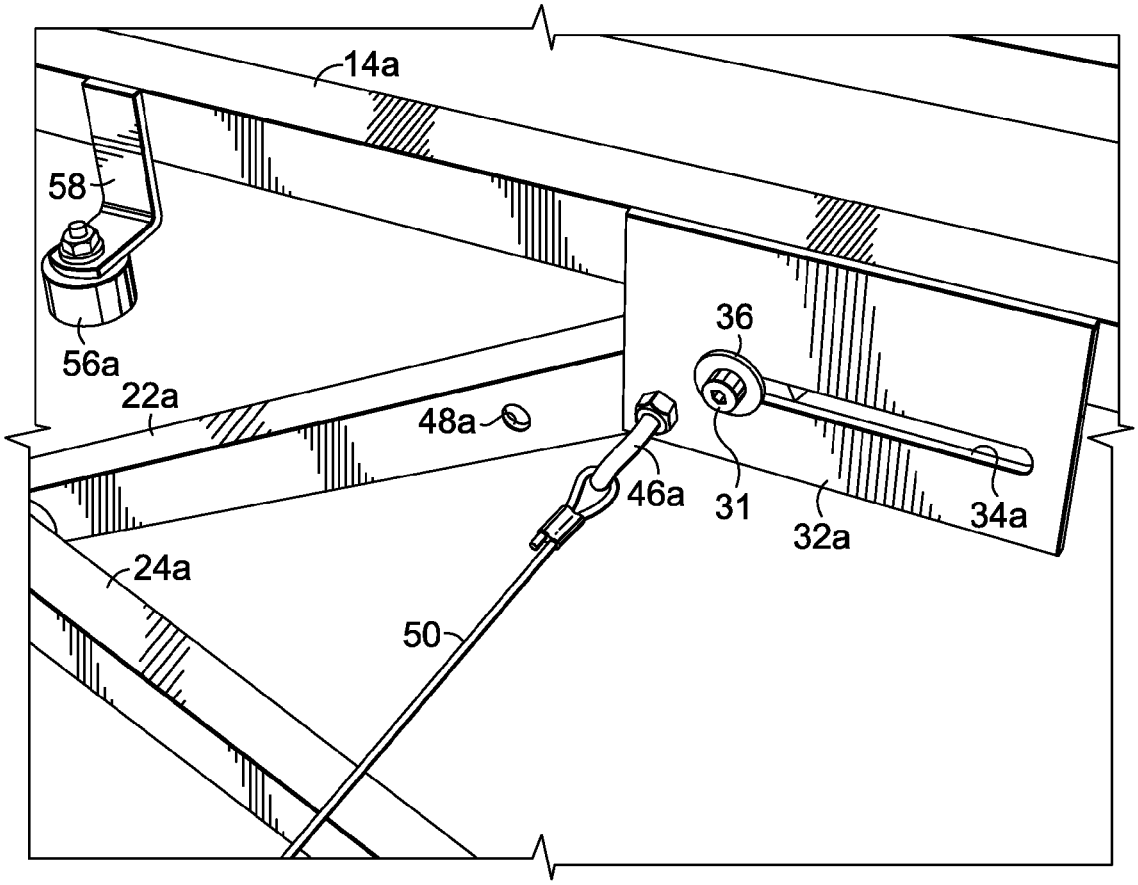
FIG. 3 is a partial, enlarged view, showing the locking plate in more detail.
Figure 4:
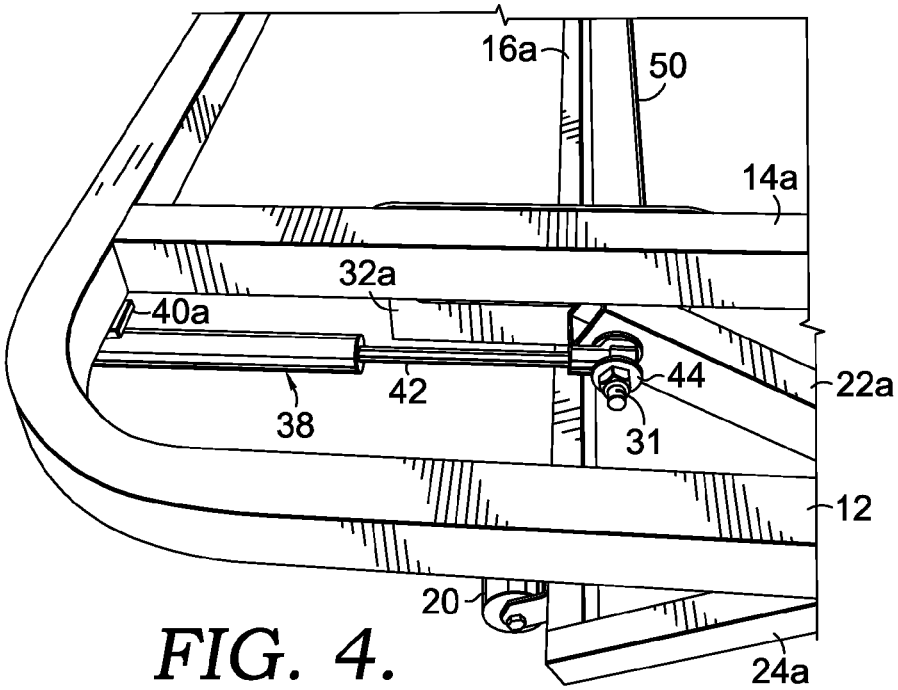
FIG. 4 is a partial, enlarged view showing the biasing member in more detail.

In further embodiments the upper end of each first arm 22*a* and 22*b* is both pivotably and slidably connectable to upper frame 12. For example, FIG. 1 depicts the upper end of each first arm 22*a* and 22*b* as pivotably and slidably coupled to cross members 14*a* and 14*b* (respectively), and thus upper frame 12. Locking plates 32*a* and 32*b* are used to achieve this coupling. Locking plate 32*a* is depicted in FIGS. 3 and 4 and locking plate 32*b* is depicted in FIGS. 1 and 2. Locking plate 32*a* will now be described in more detail; however, it should be understood that a similar description applies to locking plate 32*b* with respective components. Locking plate 32*a* might be coupled to cross member 14*a* using various components. In one embodiment, locking plate 32*a* is coupled to cross member 14*a* using fasteners, such as bolts. In other configurations locking plate 32*a* is shaped to clamp around, or otherwise fit securely around, cross member 14*a*. Preferably, locking plate 32*a* is welded to cross member 14*a*. Locking plate 32*a* extends below the plane of frame 12 and has an elongated, horizontal slot 34*a* formed therein. First arm 22*a* is pivotably coupled to locking plate 32*a* using a longer shoulder bolt 31 (as compared to shoulder bolt 30), which extends through both the upper end of first arm 22*a* and slot 34*a*. A longer shoulder bolt 31 is needed so that additional components can be operatively coupled to the first arm 22*a* using shoulder bolt 31.

In further embodiments, a biasing member 38 is coupled to first arm 22*a* by way of shoulder bolt 31. Biasing member 38 is coupled to shoulder bolt 31 opposite plate 32*a* (relative to first arm 22*a*). For instance, as shown in FIG. 3, a washer 36 may be placed between the head of bolt 31 and the locking plate 32*a*. As best seen in FIG. 4, a portion of biasing member 38 is coupled to shoulder bolt 31 on the other side of the first arm 22*a*. For example, a piston 42 of biasing member 38 is rotatably coupled to shoulder bolt 31. To facilitate smooth operation, a pair of washers 44 may be placed on either side of piston 42.

Biasing member 38 is coupled between first arm 22*a* and upper frame 12. For example, a body of the cylinder 38 is rigidly coupled to the perimeter of frame 12. In one embodiment, a cylinder bracket 40*a* is welded to perimeter tubing of frame 12, and the body of cylinder 38 is coupled to the cylinder bracket 40*a*. While one cylinder 38 is seen in the figures due to the views, it should be understood that in embodiments of our invention, each arm 22*a* and 22*b* is equipped with a cylinder 38. As such, a cylinder coupled with arm 22*b* is coupled to cylinder bracket 40*b*.

As best seen in FIG. 3, locking plate 32*a* has a locking pin 46*a*. Locking pin 46*a* will now be described in more detail; however, in embodiments of the invention, locking pin 46*b* includes similar respective components and configurations. Locking pin 46*a* has a portion that is extendable through locking plate 32*a* and into the adjacent first arm 22*a*. First arm 22*a* has a first hole 48*a* and a second hole (not shown), into which the extension portion of the pin 46*a* can extend. While in FIG. 3 only one hole 48*a* is shown, it should be understood that a second hole is positioned in first arm 22*a* behind locking plate 32*a* and that locking pin 46*a* extends into the second hole. First hole 48*a* and the second hole are located in arm 22*a* adjacent the position of the pin 46*a* in the raised and lowered positions of the frame 12. For example, when frame 12 is in a lowered position (FIG. 1), hole 48*a* is adjacent pin 46*a*, such that pin 46*a* is extendable into hole 48*a*. Alternatively, when frame 12 is in a raised position (FIGS. 2 and 3), the second hole (not shown) is adjacent pin 46*a*, such that pin 46*a* is extendable into the second hole. In one embodiment, the extension portion of pins 46*a* and 46*b* is biased to an extended position, i.e., force is applied to pins 46*a* and 46*b*, such as by a spring, to bias pin 46*a* towards an extended position. Using such an arrangement, pins 46*a* and 46*b* will extend into one of the holes in first arms 22*a* and 22*b* (respectively) when the frame 12 is placed in either the raised or lowered position. As such, pins 46*a* and 46*b* must be pulled from a respective hole in first arms 22*a* and 22*b* before the position of frame 12 can be altered. To facilitate this operation, a cable 50 is coupled to pins 46*a* and 46*b*. In one embodiment, a release lever 52 is coupled to the cable 50, preferably at a central location of frame 12 (at an equal distance between pins 46*a* and 46*b*), as shown in FIGS. 1 and 2. The lever 52 is pivotably coupled to the frame 12. In operation, the lever 52 is activated to exert a pulling force on cable 50. As best seen in FIGS. 1 and 2, the cable 50 is guided by cable guides 54 attached to the cross-supports 14. This pulling force is transferred to the ends of the pins 46*a* and 46*b*, drawing them inwardly and releasing the extension portion of the pins 46*a* and 46*b* from the holes, e.g., 48*a* and 48*b*, in first arms 22*a* and 22*b* and allowing first arms 22*a* and 22*b* to move relative to the frame 12. While spring-loaded pins 46*a* and 46*b* and a cabling system with cable 50 and lever 52 have been described, other locking embodiments are also contemplated. For example, a more-rigid "push-pull" locking arrangement can be used. In such an arrangement, the locking pins are positively removed from the locking holes 48*a* and 48*b*, and are positively moved into the locking position once aligned.

Upper frame 12 of frame 10 is dimensioned to support a desired size of mattress, such as a twin bed, double bed, etc. Upper frame 12 has an outer perimeter and is also typically provided with a number of cross-supports 14, 14*a* and 14*b*. Upper frame 12 and cross-supports 14, 14*a*, and 14*b* are preferably made with a lightweight tubing material, although other rigid manufacturing materials could of course be used. As will be understood by those of skill in the art, this upper frame is typically covered with a mattress decking material, which may be coupled to the upper frame using a series of extension springs. The decking material and the upper frame provide the support for a mattress.

As previously described, in some embodiments upper frame 12 is coupled to a pair of bottom frame members 16*a* and 16*b* through a pair of scissor arms 18*a* and 18*b*. The bottom frame members 16*a* and 16*b*, like the upper frame 12, are preferably made from a lightweight tubing material. Each of the bottom frame members 16*a* and 16*b* has a pair of casters 20. Casters 20 allow the trundle-bed frame 10 to be easily rolled to and from a storage location. Additionally, the casters 20 allow the bottom frame members 16*a* and 16*b* to roll toward each other as the frame 10 is raised, and away from each other as the frame 10 is lowered.

As best seen in FIGS. 1, 2 and 3, a stop 56*a* and 56*b* is rigidly coupled to each cross-member 14*a* and 14*b* to which the scissor linkages 18*a* and 18*b* are coupled. Stops 56*a* and 56*b* are preferably made of a slightly resilient material, such as a hard rubber. In an alternative embodiment, each of stops 56*a* and 56*b* include a spring. Stops 56*a* and 56*b* function as a cushion when cross-members 14*a* and 14*b* are lowered and come into contact with respective arms. In addition, stops 56*a* and 56*b* assist with raising frame 10 from a lowered position. For example, when frame 10 is lowered to a configuration for storing, stops 56*a* and 56*b* are compressed against respective arms. Upon initiation of raising frame 10, stops 56*a* and 56*b* are released from a compressed state to assist with raising frame 10. Preferably, each stop 56*a* and 56*b* is connected to a respective cross-member 14*a* and 14*b* using a respective bracket 58. In use, each stop 56*a* and 56*b* abuts a respective second arm 24*a* and 24*b* in the lowered position, and prevents further downward movement of the scissor linkage 18*a* and 18*b*.

The frame 12 is shown in the lowered, storage position in FIG. 1. In this position, the locking pins 46*a* and 46*b* are located respective holes 48*a* and 48*b* of arms 22*a* and 22*b*. The shoulder bolt 31 in each locking plate 32*a* and 32*b* is located within a respective slot 34*a* and 34*b* toward the perimeter of frame 12. To enable the frame to rise, an operator uses lever 52 to release pins 46*a* and 46*b* from respective holes 48*a* and 48*b*. Once released, the biasing force of cylinder 38 moves the upper end of each arm 22*a* and 22*b* away from the perimeter of frame 12, such that the shoulder bolt 31 in each locking plate 32*a* and 32*b* moves in respective slot 34*a* and 34*b* toward the center of frame 12. This movement causes the scissors arms 18*a* and 18*b* to open, thus raising upper frame 12 relative to the floor (and thus any mattress on frame 12). The cylinder 38 provides a smooth, slow, controlled motion to the linkages. This motion continues until locking pins 46*a* and 46*b* are aligned with the second hole in arms 22*a* and 22*b*, a configuration that is depicted in FIG. 3. Once aligned, the spring-loaded extension portions of the pins 46*a* and 46*b* engage the second holes, thereby locking the upper frame 12 in the raised position. To again lower the frame 12, the lever 52 is used to release pins 46*a* and 46*b*, and the operator places a downward force on upper frame 12 to overcome the bias of cylinder 38, until pins 46*a* and 46*b* are again aligned with holes 48*a* and 48*b*. Once pins 46*a* and 46*b* are aligned with holes 48*a* and 48*b*, the spring-loaded extension portion of each pin extends into a respective hole.

As can be seen, a pop-up style trundle bed is provided that achieves a slower, more-controlled motion than previous beds. The bed positively locks into the raised and lowered position, and does so with a lightweight frame made primarily from lightweight tubing.

Many different arrangements of the various components depicted, as well as components not shown, are possible without departing from the scope of the claims below. Embodiments of our technology have been described with the intent to be illustrative rather than restrictive. Alternative embodiments will become apparent readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A bed frame comprising:

a first and a second set of scissor arms, wherein each set of scissor arms comprises a first arm pivotally coupled to a second arm, each of said first and second arms having a respective upper end and a respective lower end;

a generally rectangular upper frame coupled to the respective upper end of each of said first and second arms, wherein the first arm of each set of scissor arms is both pivotally and slidably connected to the upper frame and the second arm of each set of scissor arms is pivotally connected to the upper frame;

a biasing member comprising a first terminating end and a second terminating end, the biasing member coupled at the first terminating end to the upper frame and coupled at the second terminating end to the first arm of the first set of scissor arms; and a locking pin positioned to engage one of a plurality of holes arranged in the first arm of the first set of scissor arms.

2. The bed frame of claim 1, wherein the first and second set of scissor arms are positioned on opposed sides of the generally rectangular upper frame.

3. The bed frame of claim 1, wherein the respective lower end of the first arm and the second arm of each set of scissor arms are operably coupled to casters.

4. The bed frame of claim 1, wherein the respective lower end of each first and second arm is coupled to a respective caster.

5. The bed frame of claim 1, wherein the bed frame further comprises a first bottom frame member coupled to the respective lower end of each first arm and a second bottom frame member coupled to the respective lower end of each second arm; and wherein each bottom frame member has a plurality of casters coupled thereto.

6. The bed frame of claim 1, wherein:

the first arm of each set of scissor arms is coupled to a respective locking plate fixed to the upper frame;

each respective locking plate includes a horizontal slot formed therein; and to both pivotally and slidably couple each first arm to the respective locking plate, a respective fastener extends through both the first arm and the horizontal slot formed in the respective locking plate.

7. The bed frame of claim 6, wherein the second terminating end of the biasing member is coupled to the respective fastener that couples the first scissor arm of the first set of scissor arms to the respective locking plate, such that actuation of the biasing member slides the respective fastener along a respective horizontal slot, thereby also moving the first arm of the first set of scissor arms.

8. The bed frame of claim 1, wherein the locking pin is a spring-loaded locking pin coupled to a cable; and wherein pulling on the cable disengages the spring loaded locking pin from the one of a plurality of holes.

9. The bed frame of claim 1 further comprising:

a second biasing member comprising a first terminating end and a second terminating end, the second biasing member coupled at its first terminating end to the upper frame and coupled at its second terminating end to the first arm of the second set of scissor arms; and a second locking pin positioned to engage one of a plurality of holes arranged in the respective first arm of the second set of scissor arms.

10. The bed frame of claim 9, wherein:

the first locking pin and the second locking pin are spring-loaded locking pins;

the first locking pin and the second locking pin are tethered by a cable; and pulling on the cable disengages both the first locking pin and the second locking pin from a respective one of a plurality of holes.

11. The bed frame of claim 1, wherein the upper frame comprises a plurality of cross supports;

wherein the first arm of the first set of scissor arms is both pivotably and slidably connected to a first cross support member and the second arm of the first set of scissor arms is pivotally connected to the first cross support member; and wherein the first arm of the second set of scissor arms is both pivotably and slidably connected to a second cross support member and the second arm of the second set of scissor arms is pivotally connected to the second cross support member.

12. The bed frame of claim 11, wherein the first cross support member and the second cross support member each has a respective stop coupled thereto; and wherein each respective stop is positioned to engage a respective set of scissor arms when the upper frame is lowered towards the respective lower end of each arm.

13. The bed frame of claim 1, wherein the biasing member is operable to raise and lower the upper frame in an evenly controlled motion.

14. The bed frame of claim 13, wherein the biasing member includes a gas cylinder in combination with a piston.

15. A positioning assembly for raising and lowering a mattress-supporting frame of a bed frame, the positioning apparatus comprising:

a first and a second set of scissor arms, wherein:

(1) each set of scissor arms comprises a first arm pivotally coupled to a second arm, each of said first and second arms having an upper end and a lower end;

(2) the upper end of each of said first and second arms is attachable to the mattress-supporting frame; and (3) the first scissor arm of each set of scissor arms is both pivotably and slidably connectable to the mattress-supporting frame and the second scissor arm of each set of scissor arms is pivotably connectable to the mattress-supporting frame;

a biasing member comprising a first terminating end and a second terminating end, the biasing member attachable at the first terminating end to the mattress-supporting frame and coupled at the second terminating end to the first arm of the first set of scissor arms; and a first locking pin positioned to engage one of a plurality of holes arranged in the first arm of the first set of scissor arms.

16. The positioning assembly of claim 15 further comprising a first locking plate for pivotably and slidably connecting the first arm of the first set of scissor arms to the mattress-supporting frame and a second locking plate for pivotably and slidably connecting the first arm of the second set of scissor arms to the mattress-supporting frame, wherein:

each locking plate has a slot formed therein for receiving a respective fastener, which couples the locking plate to the respective first arm; and the first locking plate supports the first locking pin.

17. The positioning assembly of claim 16, wherein the second terminating end of the biasing member is rotatably coupled to the respective fastener of the first locking plate; and wherein force exerted by the biasing member both slides the respective fastener of the first locking plate along the slot of the first locking plate and positions the first arm of the first set of scissor arms relative to the mattress-supporting frame.

18. The positioning assembly of claim 17 further comprising:

a second biasing member comprising a first terminating end and a second terminating end, the second biasing member attachable at the first terminating end to the mattress-supporting frame and coupled at the second terminating end to the first arm of the second set of scissor arms; and a second locking pin secured in the second locking plate, the second locking pin for engaging one of a plurality of holes arranged in the first arm of the second set of scissor arms.

19. The positioning apparatus of claim 18, wherein the first locking pin and the second locking pin are spring loaded;

wherein the first locking pin and the second locking pin are tethered by a cable; and wherein pulling on the cable disengages both the first locking pin and the second locking pin from a respective one of a plurality of holes.

20. A bed frame comprising:

a first and a second bottom frame member comprising one or more casters;

coupled to both bottom frame members, a first and a second set of scissor arms, wherein:

(1) each set of scissor arms comprises a first arm pivotally coupled to a second arm, each arm having a lower end and an upper end; and (2) the lower end of each arm is coupled to one of the bottom frame members;

an upper frame coupled to the upper end of each arm, the upper frame comprising a first locking plate and a second locking plate, each locking plate comprising a respective horizontal slot formed therein, wherein:

(1) the first arm of the first set of scissor arms is both pivotably and slidably connected to the first locking plate by a first fastener passing through both the first arm of the first set of scissor arms and the respective horizontal slot in the first locking plate;

(2) the first arm of the second set of scissor arms is both pivotably and slidably connected to the second locking plate by a second fastener passing through both the first arm of the second set of scissor arms and the respective horizontal slot in the second locking plate; and (3) the second arm of each set of scissor arms is pivotally coupled to the upper frame;

a biasing member comprising a first terminating end and a second terminating end, the biasing member coupled at the first terminating end to the upper frame and coupled at the second terminating end to the first fastener, such that actuation of the biasing member slides the first fastener in an evenly controlled motion along a respective horizontal slot in the first locking plate, thereby also moving the first arm of the first set of scissor arms in an evenly controlled motion respective to the upper frame; and a first locking pin positioned to engage one of a plurality of holes arranged in the first arm of the first set of scissor arms.

* * * * *